US006289552B1

(12) United States Patent
McCormick

(10) Patent No.: US 6,289,552 B1
(45) Date of Patent: Sep. 18, 2001

(54) VACUUM CLEANER WITH DUAL AGITATOR WINDOWS

(75) Inventor: Michael J. McCormick, Danville, KY (US)

(73) Assignee: Matsushita Electric Corporation of America, Secaucus, NJ (US)

( * ) Notice: Subject to any disclaimer, the term of this patent is extended or adjusted under 35 U.S.C. 154(b) by 0 days.

(21) Appl. No.: 09/575,912

(22) Filed: May 23, 2000

Related U.S. Application Data

(60) Provisional application No. 60/144,553, filed on Jul. 16, 1999.

(51) Int. Cl.[7] ..... A47L 9/30
(52) U.S. Cl. ..... 15/324; 15/325; 15/339
(58) Field of Search ..... 15/324, 339, 325

(56) References Cited

U.S. PATENT DOCUMENTS

| | | | | |
|---|---|---|---|---|
| 1,347,166 | | 7/1920 | Kirby . | |
| 1,996,934 | | 4/1935 | Siedle . | |
| 2,107,016 | * | 2/1938 | Snyder | 15/324 |
| 2,217,174 | | 10/1940 | Langille . | |
| 2,475,808 | * | 7/1949 | Storm | 15/324 X |
| 2,575,554 | | 11/1951 | Langille . | |
| 2,682,604 | * | 6/1954 | Gerber | 15/324 X |
| 3,253,295 | | 5/1966 | Waters . | |
| 4,068,341 | | 1/1978 | Scott et al. . | |
| 4,392,271 | | 7/1983 | Sepke . | |
| 5,575,035 | * | 11/1996 | Reis et al. | 15/324 |

FOREIGN PATENT DOCUMENTS

| | | | | |
|---|---|---|---|---|
| 600236 | * | 4/1948 | (GB) | 15/324 |

* cited by examiner

*Primary Examiner*—Chris K. Moore
(74) *Attorney, Agent, or Firm*—King & Schickli, PLLC

(57) ABSTRACT

A vacuum cleaner includes a housing having a nozzle that incorporates an agitator cavity. A rotary agitator is received in the agitator cavity. A light source is held in an illumination compartment carried on the housing. A first window divides the illumination compartment from the agitator cavity and a second window provides an outer facing for the illumination compartment. The light source illuminates the agitator which is viewed through the first and second windows.

14 Claims, 5 Drawing Sheets

VACUUM CLEANER WITH DUAL AGITATOR WINDOWS

This application claims benefit of provisional application 60/144,553, filed Jul. 16, 1999.

TECHNICAL FIELD

The present invention relates generally to the vacuum cleaner art and, more particularly, to a vacuum cleaner incorporating a unique multiple window assembly to allow both clear viewing of the rotary agitator of the vacuum cleaner and enhanced illumination of the floor in front of the vacuum cleaner during its operation.

BACKGROUND OF THE INVENTION

A vacuum cleaner is an electro-mechanical appliance utilized to effect the dry removal of dust, dirt and other small debris from carpets, rugs, fabrics or other surfaces in both domestic and industrial environments. In order to achieve the desired dirt and dust removal, a rotary agitator is provided to beat dirt and dust from the nap of the carpet and a pressure drop or vacuum is used to force air entrained with this dirt and dust into the nozzle of the vacuum cleaner. The particulate-laden air is then drawn through a bag-like filter or a cyclonic separation chamber and filter combination which traps the dirt and dust, while the substantially clean air is exhausted by an electrically operated fan that is driven by an on board motor. It is this fan and motor arrangement that generates the drop in air pressure necessary to provide the desired cleaning action. Thus, the fan and motor arrangement is commonly known as the vacuum or suction generator.

One critical factor in garnering consumer satisfaction for a vacuum cleaner is its convenience features. Toward this end, it is desirable for the operator to be able to quickly and easily visually confirm the proper functioning of various components of the vacuum cleaner and thus, the efficient operation thereof. Additionally, it is desirable to provide illumination of the floor forward of the vacuum cleaner during the cleaning operation. This allows the operator to visually direct and confirm proper cleaning by the vacuum cleaner in dark corners, as well as, under chairs, beds and other overhead obstructions.

Various attempts have been made in the prior art to address these needs and concerns. For example, U.S. Pat. Nos. 2,217,174 and 2,575,554 both to Langille disclose vacuum cleaners incorporating lights for illuminating the floor in front of the vacuum cleaner. In U.S. Pat. No. 2,217,174 the headlight is set back from the front wall of the vacuum cleaner and projects through a prismed lens. In U.S. Pat. No. 2,575,554, the front wall of the vacuum cleaner incorporates a window 52 through which the light is projected. While these patents provide a good means of illuminating the floor in front of the vacuum cleaner to allow efficient cleaning in shadowy or dark areas, they provide no means for viewing operation of various components of the vacuum cleaner such as, a rotary agitator to confirm that it is functioning properly.

U.S. Pat. No. 4,392,271 to Sepke discloses a vacuum cleaner incorporating a transparent viewing window that overlies the rotary agitator so as to allow visual confirmation of the proper operation of the agitator and/or any erratic movement or slipping of the belt that drives the agitator. The vacuum cleaner disclosed in U.S. Pat. No. 4,392,271, however, fails to provide any effective means for illuminating (1) the agitator so as to aid in its viewing; or (2) the floor in front of the vacuum cleaner to aid in efficient and effective floor cleaning.

Accordingly, it should be appreciated that while prior art vacuum cleaners have sought to individually address concerns respecting visual confirmation of component operation and effective illumination of the floor forward of a vacuum cleaner, no design of a vacuum cleaner to date has effectively addressed each of these issues simultaneously.

SUMMARY OF THE INVENTION

In accordance with the purposes of the present invention as described herein, an improved vacuum cleaner is provided. The vacuum cleaner includes a housing having a nozzle with an agitator cavity. An agitator is mounted in the agitator cavity for rotation relative to the housing. A suction generator and an illumination compartment are both carried on the housing. A light source is held in the illumination compartment while a first window divides the illumination compartment from the agitator cavity and a second window provides an outer facing for the illumination compartment which distributes and projects light forward of the vacuum cleaner. Thus, the windows function to allow simultaneous illumination of the rotary agitator and the work area immediately in front of the vacuum cleaner from a single light source, as well as a clear path for viewing the agitator.

The second window at least partially overlies the first window in a vertical plane, while the light source at least partially overlies the agitator in a vertical plane. In our embodiment, the first and second windows, the light source and the agitator all at least partially overlie each other in a vertical plane. This stacked arrangement allows for an overall reduction in the length or fore-aft dimension of the nozzle assembly which in turn makes for easier manipulation when moving the vacuum cleaner into comers and around furniture and other objects.

Still more specifically describing the invention, the second window of the vacuum cleaner incorporates at least one prism for bending light forward and downward to illuminate the work area of the floor immediately in front of the vacuum cleaner. This aids the operator in cleaning in shadows cast, for example, by the operator or furniture such as chairs and beds.

In addition, the bumper guard over the front wall of the housing preferably includes an opening for allowing the passage of light from the light source and the second window preferably includes a front portion that closes that opening. Thus, the floor immediately in front of the vacuum cleaner is directly illuminated. In one embodiment, that front portion is arch shaped. Where the second window is molded in one piece from a transparent plastic material the arch shape allows for better strength and rigidity. In addition, as a result of this spatial arrangement the first and second windows overlie the forward gap between the agitator and the inner nozzle wall to allow for visual inspection thereof. This allows the operator to easily confirm that the vacuum cleaner is working at utmost efficiency without any obstructions that might cause the agitator to bind or otherwise restrict or reduce airflow and, therefore, cleaning power.

Alternatively, the present invention may be defined as including a vacuum cleaner having a nozzle housing for holding a rotary agitator and a novel agitator window assembly. That novel window assembly includes first and second windows that at least partially overlie the agitator. The vacuum cleaner further includes a light source for projecting light into a gap formed between the first and second window so as to illuminate the agitator. Advantageously, as noted above, the illumination of the agitator and the straight and uninterrupted path to the agitator through the two windows allows the operator to readily and conveniently confirm that the rotary agitator is functioning properly at all times.

In accordance with yet another aspect of the present invention, a method is provided for viewing an illuminated agitator of a vacuum cleaner. The method includes the steps of providing an illumination compartment overlying the agitator, flooding the illumination compartment with light and viewing the agitator through windows providing a sight path through the illumination compartment.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
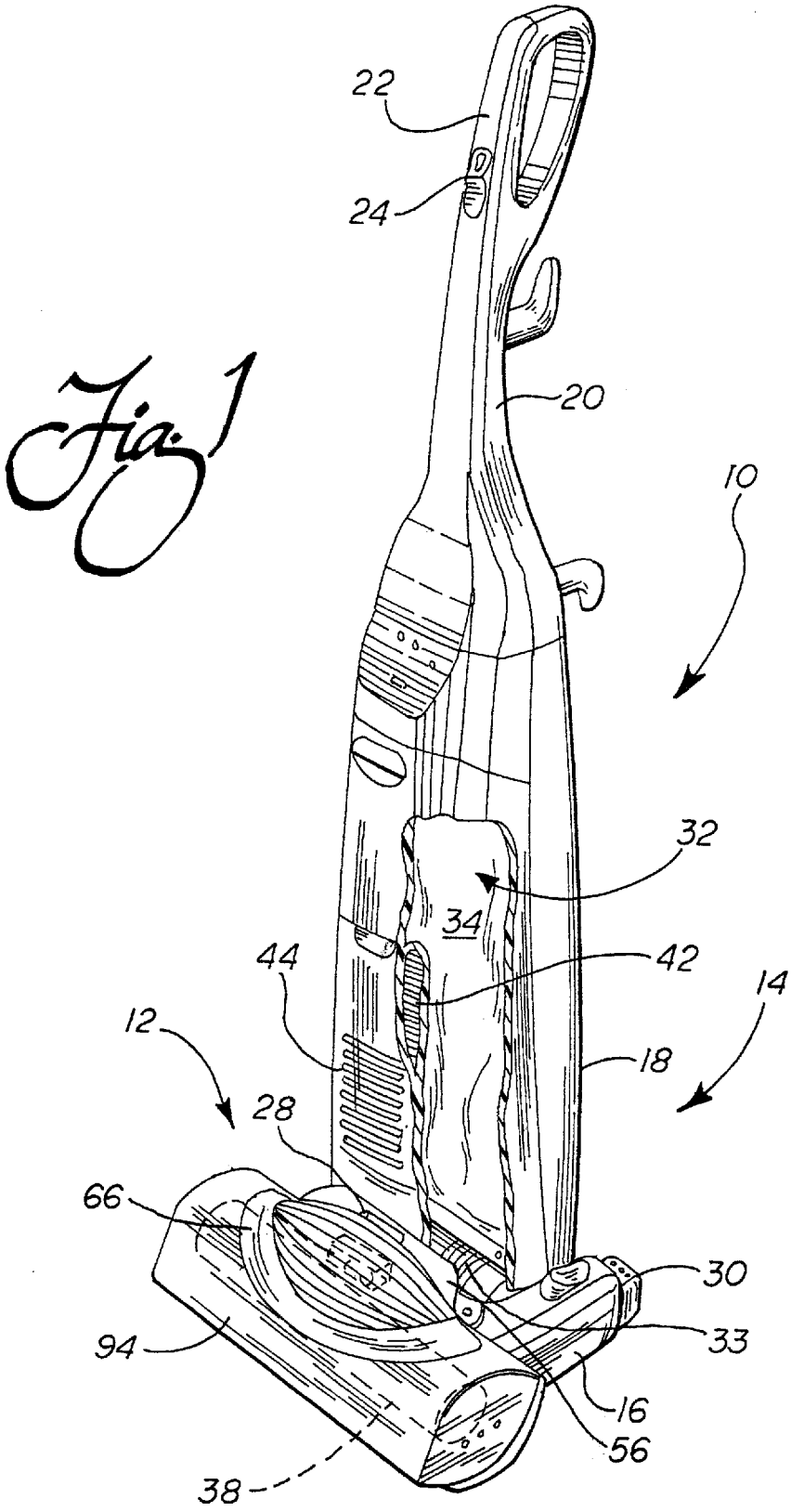
FIG. 1 is a perspective view of the vacuum cleaner of the present invention.

Reference is now made to FIG. 1 showing the vacuum cleaner 10 of the present invention which incorporates the novel agitator window assembly 12 as best shown in detail in FIGS. 2 and 3 and described further below. It should be appreciated that while an upright vacuum cleaner 10 is illustrated, canister vacuum cleaners incorporating a driven rotary agitator in what is referred to in the art as a "power nozzle" may also utilize and benefit from the novel agitator window assembly 12. As such, this invention is deemed to cover such embodiments.

The overall basic design of the upright vacuum cleaner 10 is generally well known in the art. In the typical arrangement, the upright vacuum cleaner 10 includes a housing 14 that comprises the nozzle assembly 16 and the canister assembly 18. The canister assembly 18 further includes the handle 20 and the hand grip 22. The hand grip 22 carries a control switch 24 for turning the vacuum cleaner 10 on and off. Of course, electrical power is supplied to the vacuum cleaner 10 from a standard electrical wall outlet through a cord (not shown).

At the lower portion of the canister assembly 18, rear wheels (not shown) are provided to support the weight of the vacuum cleaner 10. A pair of front wheels 26 (only one shown in FIG. 2) allow for adjustment of the height of the nozzle assembly 16 above the floor by manipulation of the slide actuator 28 through a mechanism well known in the art. To allow for convenient storage of the vacuum cleaner 10, a foot latch 30 functions to lock the canister assembly 18 in an upright position, as shown in FIG. 1. When the foot latch 30 is released, the canister assembly 18 may be pivoted relative to the nozzle assembly 16 as the vacuum cleaner 10 is manipulated to clean the floor. The canister assembly 18 also carries an internal chamber 32 that houses a suction generator 33 (i.e. a state of the art fan and motor combination) and a dust bag 34 for removing dirt or dust entrained in the air stream as it passes from the nozzle assembly 16 to the suction generator.

The nozzle assembly 16 includes a nozzle and agitator cavity 36 that houses a rotating agitator brush 38. The agitator brush 38 shown is rotatably driven by a motor 40 and cooperating gear drive (not shown) housed within the agitator (see FIG. 2) in a manner described in greater detail in copending U.S. provisional patent application serial no. [60/144,565], filed Jul. 16, 1999, entitled "Air Cooling of Vacuum Cleaner Systems", the full disclosure of which is incorporated herein by reference. Alternatively, the agitator brush 38 may be driven by a drive shaft and belt combination through the motor of the suction generator 33.

In the illustrated vacuum cleaner 10, the scrubbing action of the rotary agitator brush 38 and the negative air pressure created by the suction generator 33 cooperate to brush and beat dirt and dust from the nap of the carpet being cleaned and then draw the dirt and dust laden air from the agitator cavity 36 to the dust bag 34. Specifically, the dirt and dust laden air passes serially through a suction inlet 102 and hose 104 (not visible in FIG. 1 but see FIGS. 4*a* and 4*b*) and/or an integrally molded conduit in the nozzle assembly 16 and/or canister assembly 18 as is known in the art. Next, it is delivered into the chamber 32 and passes through the porous walls of the dust bag 34. The bag 34 serves to trap the suspended dirt, dust and other particles inside while allowing the now relatively clean air to pass freely through the wall thereof and then through the suction generator 33 and ultimately to the environment through the final filtration cartridge 42 and the exhaust port 44.

During vacuum cleaner operation there is a possibility that the rotary agitator brush 38 may become jammed in the fringe of a throw rug or by a large object wedging between the agitator and the inner housing or wall of the nozzle assembly. For these reasons, it is desirable to allow the operator some means for conveniently checking on this operating condition. Further, as the vacuum cleaner 10 is often manipulated in dark or shadowy corners and/or under furniture such as chairs, beds and tables, a headlight providing strong illumination of the floor immediately in front of the vacuum cleaner is desirable. Toward this end, the vacuum cleaner 10 of the present invention incorporates the novel agitator window assembly 12 as shown in detail in FIGS. 2 and 3.

A first transparent window 50 includes lugs 52 and a series of apertures 54 for receiving screws or other like fasteners (not shown) to allow the first window to be fixed to the nozzle assembly 16. The window 50 seals against the nozzle assembly 16 and closes the top of the agitator cavity 36. Next, a cover 56 is installed to partially close the top of the nozzle assembly 16. The cover 56 includes a pair of tabs 58 which engage in cooperating slots 60 in the nozzle assembly 16. A pair of screws (not shown) are received in a pair of cooperating apertures 62 (only one visible in FIG. 3) at the rear of the cover 56. These screws engage in bosses 64 also in the nozzle assembly 16.

A second transparent window 66 closes the opening 68 provided in the cover 56. The window 66 includes a pair of mounting lugs 70 that snap into cooperating slots 72 in the first window 50 and a pair of tabs 74 that snap into cooperating slots 76 in the cover 56 to allow the second window to be secured in a position overlying the first window. Of course, any other mounting arrangement known in the art to be suitable for this purpose may be used to mount the first and second windows 50, 66.

As should be further appreciated, the second window 66 includes a raised central section 78 and downwardly sloped, low profile sides 80. Additionally, the nozzle assembly 16 includes an overall "hammer-head" shape. Together the low profile sides 80 of the second window 66 and the hammer-head shape of the nozzle assembly 16 (i.e. side projections) provide the vacuum cleaner 10 with the necessary clearance at either side to clean in tight corners even under overhanging objects such as along the toe plate under a kitchen cabinet.

An illumination compartment 82 is defined between the two windows 50, 66 and the cover 56. A light source 84 is mounted in the illumination compartment 82 by means of a bracket 86 which carries a light shield 88. The raised central section 78 of the second window 66 provides the necessary space to accommodate the light source 84 and light shield 88. Preferably, the light shield 88 includes a reflective surface 90 for directing light forward to a series of prisms 92 in the second window 66 which redirect and distribute the light downwardly toward and across the floor in front of the vacuum cleaner 10 (note action arrow A in FIG. 2). Simultaneously, light from the light source 84 also passes downward through the first window 50 to illuminate the agitator brush 38 and any bristles, beater bars, squeegees or other cleaning structures that may be carried thereon. These cleaning structures may also be made from fluorescent materials in order to further enhance their visibility. If desired, the intensity of this light may also be increased by extending the reflective surface 90 of the light shield 88 around the light source 84 so as to overlie that light source and reflect more light downwardly directly through the first window 50.

Figure 2:
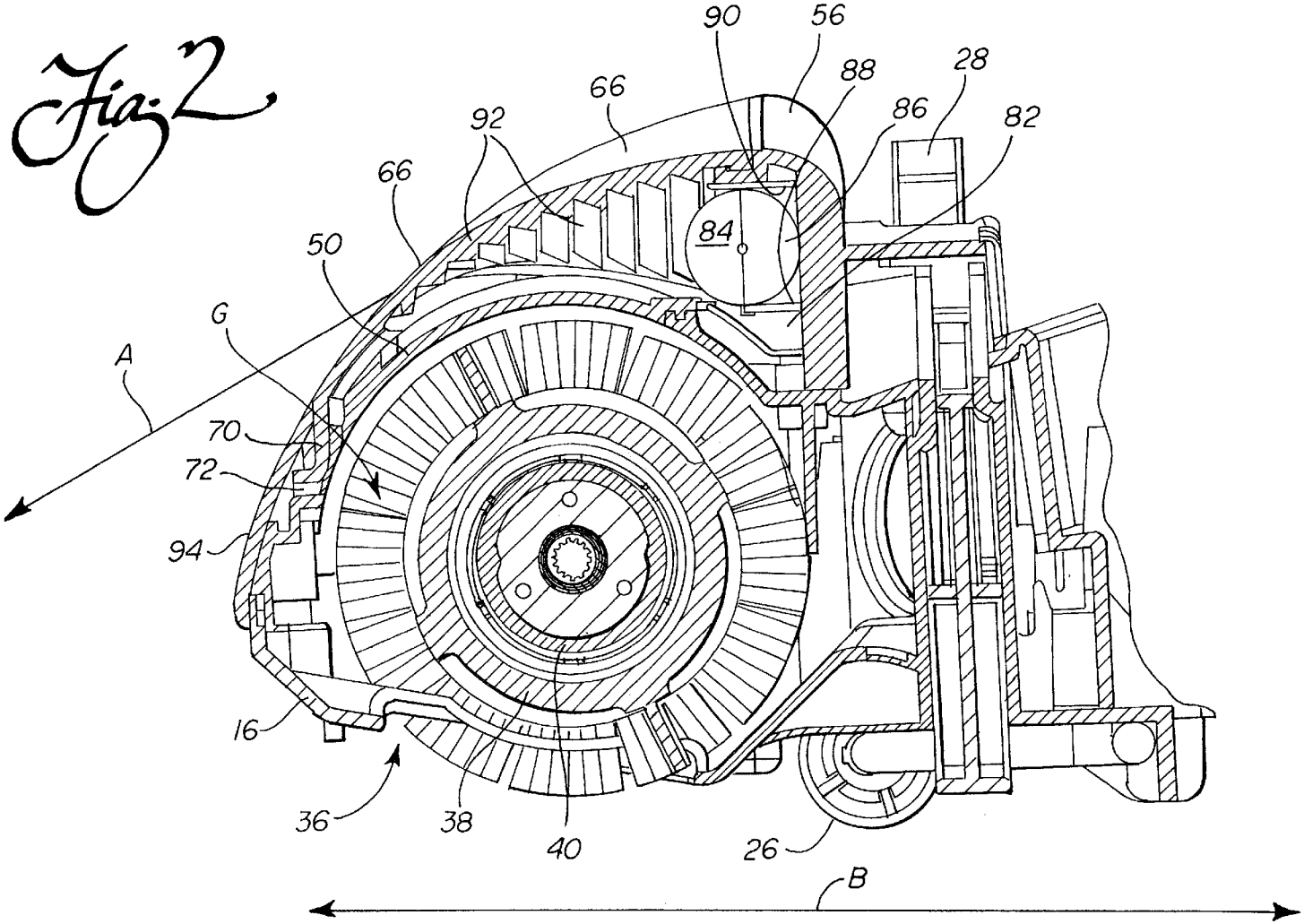
FIG. 2 is a longitudinal cross sectional view of the nozzle assembly of the vacuum cleaner of the present invention.
Figure 3:
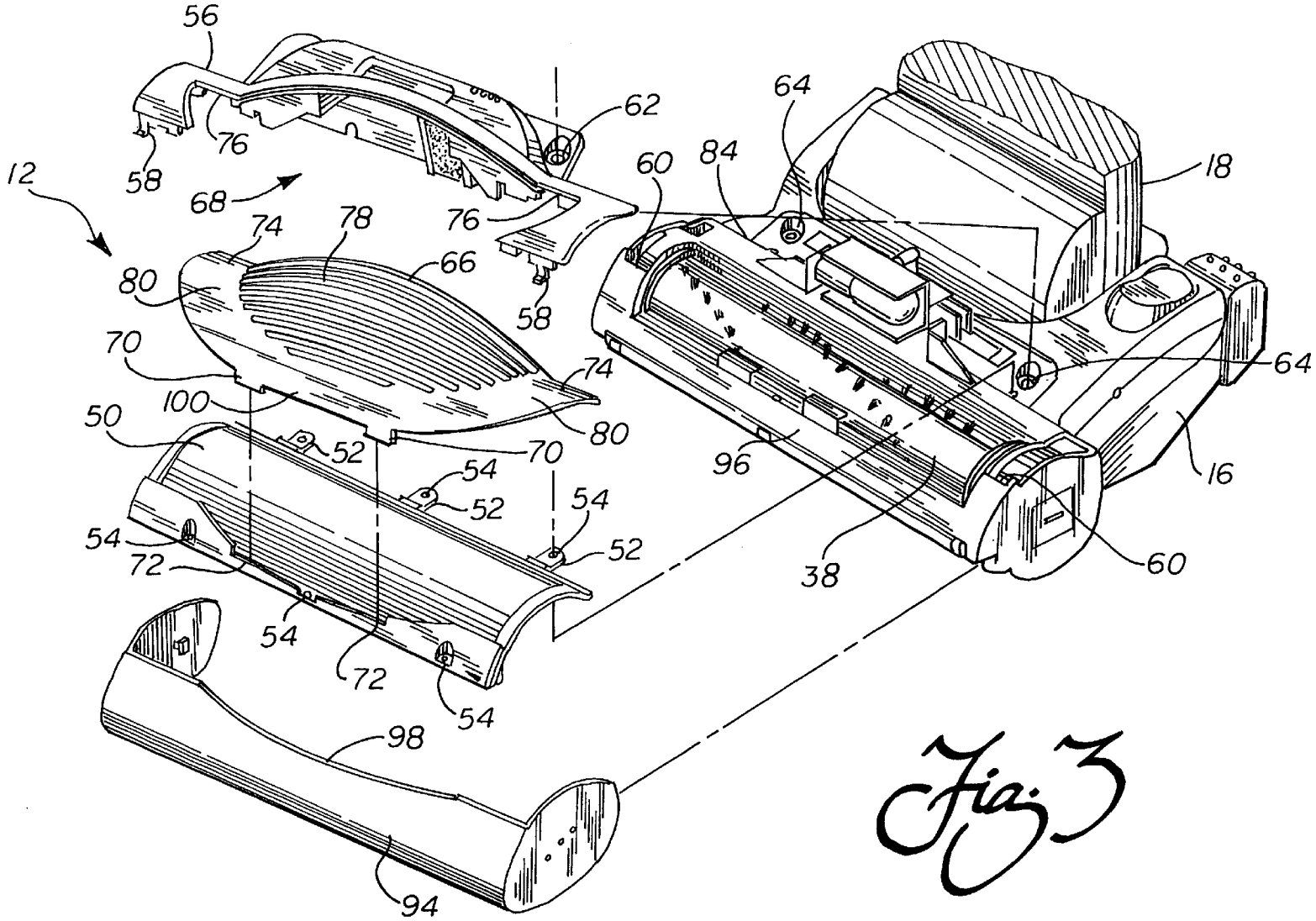
FIG. 3 is an exploded perspective view of the agitator window assembly incorporated into the vacuum cleaner of the present invention.

As should be further appreciated from viewing FIGS. 2 and 3, a bumper guard 94 overlies the front wall 96 of the nozzle assembly and the lower portion of the first window 50. The bumper guard 94 includes a cut out or opening 98. The second window 66 includes a front portion 100 that is received in the opening 98. The opening 98 and front portion 100 of the second window 66 are of matching arch shape so as to allow the second window 66 to fit flush and form an aesthetically pleasing facing for the nozzle assembly 16. Advantageously, the arch shape of the front portion 100 of the second window 66 provides a desirable lighting angle and light path which not only functions to increase the intensity of the light directed onto the floor in front of the vacuum cleaner 10 but also better distributes and focuses that light across the work area. Additionally, the bend between the two portions of the second window 54 and the arch shape allow the second window to be constructed of greater strength so as to better withstand occasional inadvertent engagement with objects such as furniture legs or baseboards.

As also made clear from viewing FIG. 2, the first window 50, the second window 66, the light source 84 and the agitator brush 38 all at least partially overlie each other in a vertical plane. As such, the nozzle assembly 16 may be made shorter so as to present a reduced fore-aft dimension (note dimension line B in FIG. 2). This, advantageously, allows the vacuum cleaner 10 to be more easily manipulated around tight radius turns such as may be necessary when cleaning in corners and around certain arrangements of furniture. It also allows the nozzle assembly 16 to be made from less material so that it is thereby lighter in weight. This again aids in the ease of manipulation of the vacuum cleaner 10. Further, it should be noted that the stacked arrangement still allows the nozzle assembly 16 to include a low profile with the necessary clearance for cleaning under objects such as beds, dressers and cabinets.

Another important advantage produced as a result of the relative placement of the light source 84 with respect to the agitator brush 38 and the provision of the arch-shaped portion 100 of the second window 66 is the ability to readily view the condition of the front gap G of the agitator cavity 36 between the rotary agitator brush 38 and the forward wall of the nozzle 36. This allows the operator to monitor the condition of this gap G at a glance to confirm if any obstruction exits that will interfere with the rotation of the agitator brush 38 or the suction of the vacuum cleaner.

In summary, numerous benefits results from employing the concepts of the present invention. The dual window arrangement allows better forward lighting of the floor in front of the vacuum cleaner through an increase in light intensity and an enhancement of light distribution over the work area. Additionally, the dual window system simultaneously allows the operator to view the operating condition of the vacuum cleaner including particularly the rotation of the rotary agitator brush 38 and the condition of the gap G between that brush and the forward wall of the nozzle 36. The illumination of the agitator brush 38 and gap G by means of the light source 84 ensures excellent visibility and utmost ease of inspection.

Figure 4A:
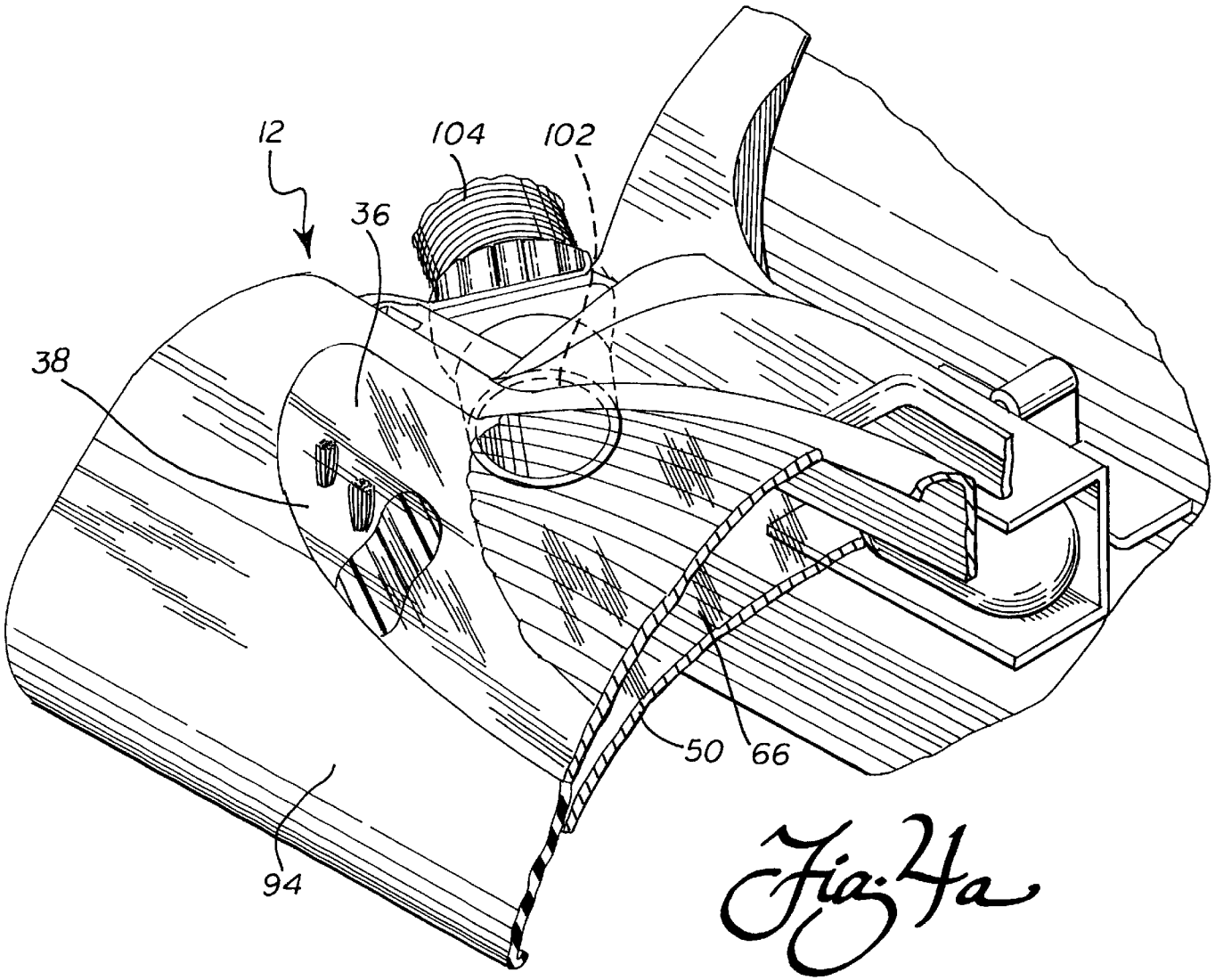
FIG. 4*a* is a detailed, partially cutaway and perspective view of an alternative embodiment of the present invention showing the first and second windows overlying a suction inlet providing fluid communication between the suction generator and agitator cavity of the vacuum cleaner.
Figure 4B:
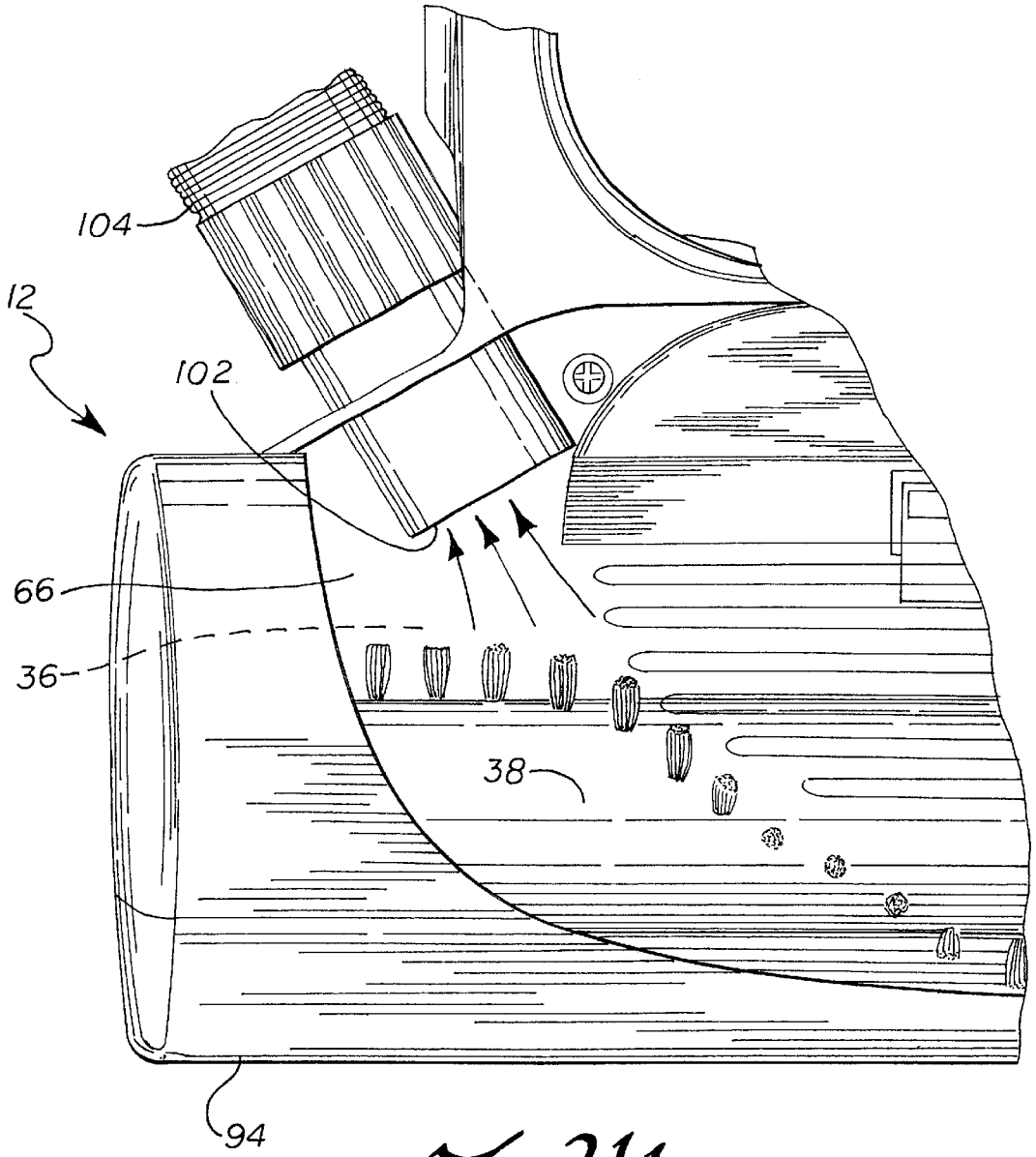
FIG. 4*b* is a detailed top plan view showing the embodiment of FIG. 4*a*.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the two windows 50, 66 could be extended rearwardly as shown in FIGS. 4*a* and 4*b* to extend over the suction inlet 102 leading from the agitator cavity 36 to the suction generator 33. In this way, it is possible to conveniently check or visually inspect the suction inlet 102 for clogging and thereby insure that peak vacuum cleaner performance is being maintained at all times.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A vacuum cleaner, comprising:

a housing including a nozzle having an agitator cavity;

an agitator in said agitator cavity mounted for rotation relative to said housing;

a suction generator carried on said housing;

an illumination compartment carried on said housing;

a light source held in said illumination compartment;

a first window dividing said illumination compartment from said agitator cavity; and a second window providing an outer facing for said illumination compartment.

2. The vacuum cleaner of claim 1 wherein said second window at least partially overlies said first window in a vertical plane.

3. The vacuum cleaner of claim 1, wherein said light source at least partially overlies said agitator in a vertical plane.

4. The vacuum cleaner of claim 1, wherein said first window, said second window, said light source and said agitator at least partially overlie each other in a vertical plane.

5. The vacuum cleaner of claim 1, wherein said first window is transparent and at least partially overlies said agitator thereby providing a direct light path between said light source and said agitator.

6. The vacuum cleaner of claim 1, wherein said second window is transparent and incorporates at least one prism for bending light forward to illuminate an area in front of said vacuum cleaner.

7. The vacuum cleaner of claim 1, further including a bumper guard secured to said nozzle assembly, said bumper guard including an opening.

8. The vacuum cleaner of claim 7, wherein said second window includes a front portion that matches said opening in said bumper guard.

9. The vacuum cleaner of claim 8, wherein said bumper guard opening and said front portion are arch shaped.

10. The vacuum cleaner of claim 1, wherein said second window includes a raised central section and slopes downwardly adjacent each side.

11. The vacuum cleaner of claim 1, wherein said nozzle is hammerhead shaped.

12. The vacuum cleaner of claim 11, wherein said first and second windows overlie a suction inlet in fluid communication with said agitator cavity and said suction generator.

13. A vacuum cleaner including a nozzle housing for holding a rotary agitator, said vacuum cleaner further including an agitator window assembly, comprising:

first and second windows at least partially overlying said agitator and a light source for projecting light into a gap formed between said first and second windows so as to illuminate said agitator.

14. A method of illuminating and viewing an agitator of a vacuum cleaner, comprising:

providing an illumination compartment overlying said agitator;

flooding said illumination compartment with light; and viewing said agitator through windows providing a sight path through said illumination compartment.

* * * * *